US006837158B2

(12) United States Patent
Simpson

(10) Patent No.: US 6,837,158 B2
(45) Date of Patent: Jan. 4, 2005

(54) BALER WITH RESILIENT-WHEELED PLATEN

(76) Inventor: Edwin K. Simpson, 4132A Charlotte Hwy., Lake Wylie, SC (US) 29710

( * ) Notice: Subject to any disclaimer, the term of this patent is extended or adjusted under 35 U.S.C. 154(b) by 0 days.

(21) Appl. No.: 10/356,881

(22) Filed: Feb. 3, 2003

(65) Prior Publication Data

US 2003/0226456 A1 Dec. 11, 2003

Related U.S. Application Data

(60) Provisional application No. 60/387,485, filed on Jun. 10, 2002.

(51) Int. Cl.[7] ..... B30B 15/06

(52) U.S. Cl. ..... 100/245; 100/98 R; 100/179; 100/215; 100/269.18

(58) Field of Search ..... 100/94, 95, 96, 100/97, 98 R, 100, 178, 179, 190, 210, 215, 226, 269.18, 232, 233, 240, 245, 140, 141, 142, 143

(56) References Cited

U.S. PATENT DOCUMENTS 1,088,435 A * 2/1914 Matthews ..... 100/179
3,828,663 A 8/1974 Poplinski
3,937,140 A 2/1976 Swanson
4,355,575 A 10/1982 Goldhammer
4,497,247 A 2/1985 Goldhammer
4,729,304 A * 3/1988 Gardella et al. ..... 100/218
4,757,758 A * 7/1988 Tondo ..... 100/245
4,841,853 A 6/1989 Wallace
5,193,453 A 3/1993 Lundy
5,351,613 A * 10/1994 Newsom ..... 100/98 R
5,642,662 A 7/1997 Schwelling
5,832,815 A * 11/1998 Bollegraaf ..... 100/42

* cited by examiner

*Primary Examiner*—Allen Ostrager
*Assistant Examiner*—Jimmy T Nguyen
(74) *Attorney, Agent, or Firm*—Gardner Groff, P.C.

(57) ABSTRACT

A frame (12) with a charging chamber (14) for receiving a load of waste material, a platen (20) that moves in the charging chamber to compact the material load, and one or more wheels (44) rotatably coupled to the platen. The charging chamber (14) has a floor (34), the platen (20) has a bottom (32) that slidably contacts the floor and supports enough of the weight of the platen on the floor that none or little of the material can pass under the platen, and the wheels (44) support a substantial portion of the weight of the platen on the floor to mitigate sliding friction. The wheels (44) are made of a resilient material and deform from an unloaded state to a loaded state when supporting the substantial portion of the weight of the platen (20).

17 Claims, 4 Drawing Sheets

BALER WITH RESILIENT-WHEELED PLATEN

CROSS-REFERENCE TO RELATED APPLICATION

The present application claims the priority benefit of U.S. provisional patent application Ser. No. 60/387,485, filed on Jun. 10, 2002 and incorporates the same herein by reference.

TECHNICAL FIELD

The present invention relates generally to waste reduction equipment and, more particularly, to a machine for compacting and baling waste such as paper by horizontally moving a platen on resilient wheels.

BACKGROUND OF THE INVENTION

Facilities such as recyclers, printers, distribution centers, and grocery stores handle large amounts of waste materials such as paper, cardboard, municipal solid waste (typical office and/or household trash), and other refuse. These and other facilities often use baler machines for compacting and baling the waste materials into bundles that can be efficiently hauled away and disposed of.

Conventional balers include a compacting chamber and a ram-operated platen that moves horizontally to downwardly shear and compact the material in the chamber. In one known type of baler, the platen slides along the bottom of the chamber. This design provides a close fit between the platen and the chamber walls so that debris does not get under the moving platen. But because of the huge frictional forces generated between the heavy and downwardly shearing platen and the chamber bottom, a very powerful and energy-hungry ram is required to push the platen.

In another known type of baler, the platen is mounted on steel wheels that support its weight (and some of the weight of the ram) as the platen rolls along the bottom wall or rails of the chamber. But to support all this weight on the rigid wheels, the bottom of the platen is spaced slightly above the bottom of the chamber, leaving a small gap between the platen and the chamber bottom. As a result, when the platen rolls through the chamber to compact the material, debris can get through the gap. When the wheels roll over the debris, this elevates the platen and jams it against the top wall or guides of the chamber. This can cause the baler to seize up, and an operator must then stop the machine and clear the jam.

To avoid this problem, some balers have wipers or brushes to remove the debris before the wheels encounter it. But these wipers or brushes are not fool-proof and they require periodic maintenance and replacement, thereby adding to the costs of buying, operating, and maintaining the baler machine.

Accordingly, it can be seen that a need remains for a baler with a platen that compacts paper and/or other waste material in a highly efficient manner without periodically seizing up. In particular, there is a need for such a platen that compacts the waste material by a low-friction platen motion and that does not permit debris under the platen. Furthermore, a need exists for such a machine that can be operated to bale the waste material into bundles that can be efficiently hauled away for disposal. It is to the provision of a machine meeting these and/or other needs that the present invention is primarily directed.

SUMMARY OF THE INVENTION

The present invention overcomes the deficiencies of the prior art by providing a compactor/baler with a platen on wheels that support some of the weight of the platen to reduce sliding frictional forces. In this manner, the compactor/baler uses more of the available power in the compacting process, with less power wasted by friction. Also, the rest of the weight of the platen is supported by the bottom of the platen so that none or only very little of the waste material can get under the platen. If any waste material does get under the platen, the wheels deform as they roll over it so that the platen does not rise and create a jam and/or let more material under it.

Generally described, the compactor/baler includes a frame with a charging chamber for receiving a load of the material, a platen that moves in the charging chamber to compact the material load, and one or more wheels coupled to the platen. The charging chamber has a bearing surface, the platen has a sliding surface that contacts and slides on the bearing surface while it at least partially supports the platen, and the wheels at least partially support the platen on the bearing surface.

The wheels support a substantial portion of the weight of the platen to mitigate sliding friction, but the sliding surface still contacts and supports enough of the weight of the platen that none or little of the material can pass under the platen. For example, the wheels may support a majority fraction of the weight of the platen and the sliding surface may support a minority fraction of the weight of the platen.

In order for the wheels and the sliding surface to share the weight of the platen, the wheels can be made of a resilient material such as polyurethane or another elastomer. In this way, the wheels can deform from an unloaded state to a loaded state when supporting their share of the platen weight.

Also, the bearing surface may be a floor of the charging chamber and the sliding surface may be a bottom of the platen. Additionally, the platen may have a top guide surface and the charging chamber may have one or more guides that slidably engage and constrain the platen top so that the platen bottom cannot be elevated from the charging chamber floor. This helps to keep the material from getting under the bottom of the platen. But if some of the material does get under the platen, the wheels can further deform as they roll over the material so that the platen top does not jam into the guides and stop the platen motion.

In order to shear off the load of material as the platen moves in the charging chamber, the compactor/baler can include a knife assembly. As the knife assembly shears the material, it generates downward forces on the platen that are borne on the chamber floor by the platen bottom. The knife assembly can be provided by a first cutting surface at the platen and a second cutting surface at the frame. For example, the first cutting surface can be provided by a bar extending across and forward from a front wall upper portion of the platen, and the second cutting surface can extend across a distal wall upper portion of the charging chamber.

Additionally, the compactor/baler may be provided with a hydraulic ram or other actuator that moves the platen in the charging chamber. Also, the baler can have a hopper for feeding the material into the charging chamber and a compression chamber for further compacting the material.

These and other objects, features, and advantages of the present invention will become more apparent upon reading the following description in conjunction with the accompanying drawing figures.

BRIEF DESCRIPTION OF THE DRAWING FIGURES

DETAILED DESCRIPTION OF THE PREFERRED EMBODIMENTS

The present invention provides for compacting waste materials into bundles that can be baled and efficiently hauled away and disposed of. For example, the present invention can be used by facilities such as recyclers, printers, distribution centers, and grocery stores for processing waste materials such as paper, cardboard, municipal solid waste, and/or other refuse. Of course, the invention can be used by other facilities or persons for compacting other types of materials, with or without the baling process.

Figure 1:
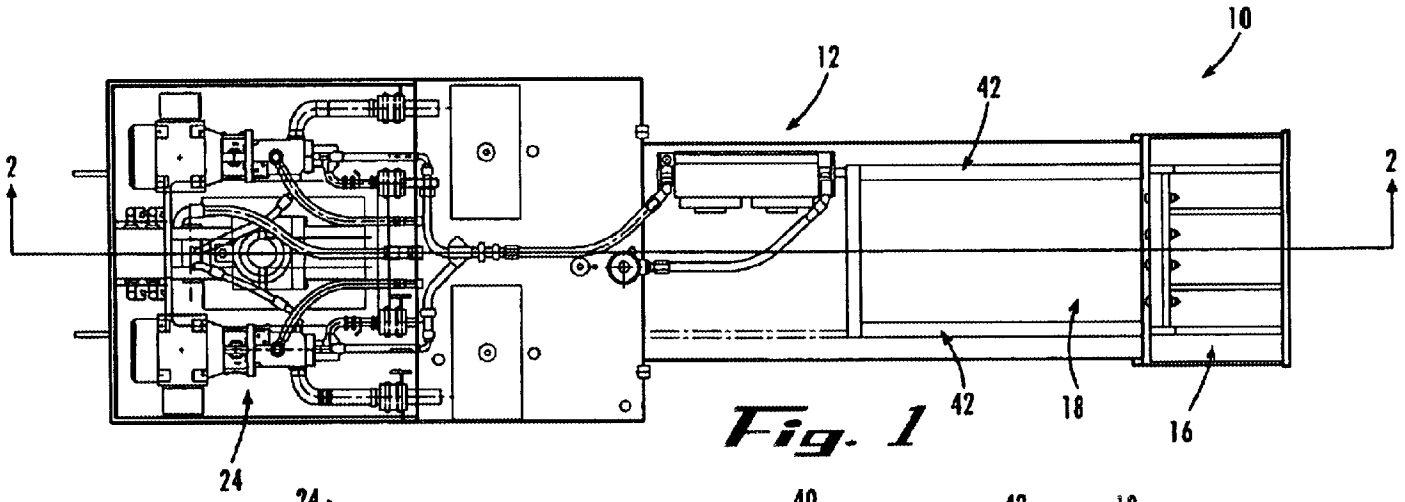
FIG. 1 is a plan view of a compacting machine according to a first exemplary embodiment of the present invention.
Figure 2:
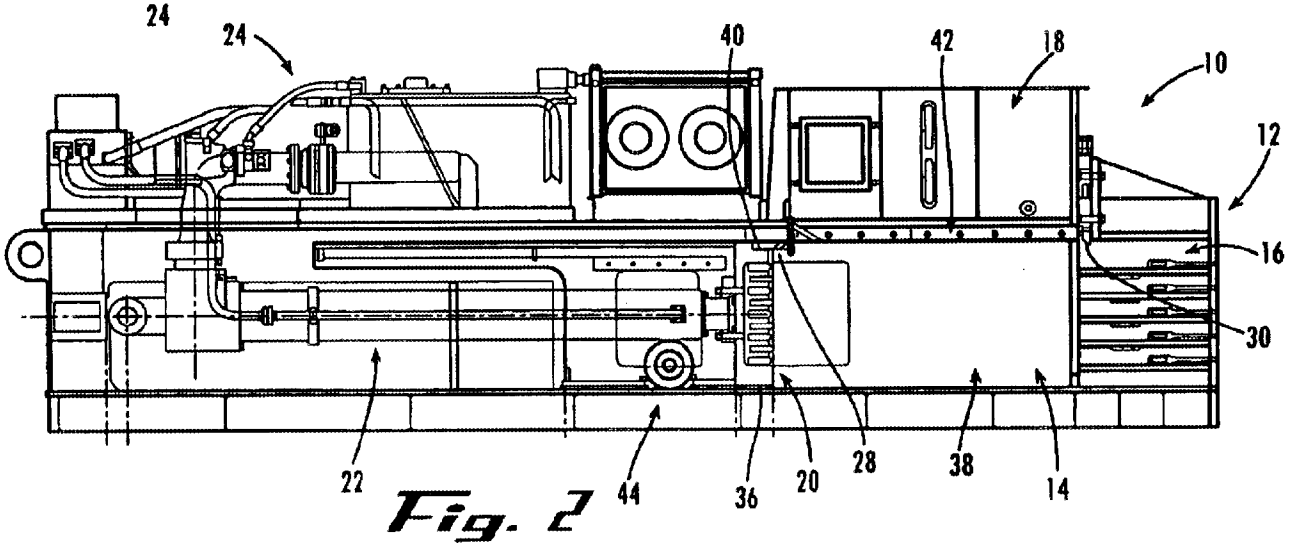
FIG. 2 is a cross sectional view of the compacting machine taken at line 2—2 of FIG. 1.

Referring now to the drawing figures, wherein like reference numerals represent like parts throughout the several views, FIGS. 1 and 2 show an exemplary embodiment of the present invention, referred to generally as a compacting machine 10. The machine 10 has a machine frame 12 with a charging chamber 14, a compression chamber 16, a hopper 18, a baling section (not shown), a platen 20. Also, the machine 10 has an actuator 22 for moving the platen, and a control system 24 for operating the actuator.

The hopper 18 is positioned above or otherwise adjacent the charging chamber 14, for feeding material into the charging chamber. To compact the material in the charging chamber 14, the platen 20 moves through it and compresses the material against the walls of the charging chamber. The compression chamber 16 is positioned adjacent the charging chamber 14 and opposite the platen 20 at the far end of the charging chamber, for providing additional compacting space. In order to bale the compacted material, the baling section is provided adjacent the compression chamber 16 opposite the charging chamber 14.

It will be understood that the baling section can be provided by conventional balers known in the art, so details of this component are not included herein. And in some applications the machine may be provided without the baling section and/or without the compression chamber.

In order to move the platen 20, the actuator 22 is coupled to it to push, pull, rotate, or otherwise move the platen through the charging chamber 14. In a typical commercial embodiment, the actuator 22 is provided by one or more linear hydraulic rams. For example, the hydraulic ram can include a 16-inch, 5000 psi hydraulic cylinder operated by two 100 hp motors. Of course, other actuators may be suitably employed, such as pneumatic cylinders, linear or rotary electric motors, combustion engines, or hydraulic rams in other configurations.

When the actuator 22 is provided by a hydraulic ram, the control system 24 includes fluid hoses, valves, gauges, and other conventional control components selected and configured for operating the ram. For other types of actuators, other types of conventional controls can be selected by one skilled in the art for controlling the movement of the actuator.

In addition, the machine 10 can be provided with a knife assembly that shears off a load of material in the charging chamber 14 as the platen 20 is moved through the charging chamber. In this way, the load of the material in the charging chamber 14 is separated from the rest of the material in the hopper 18. Then the load of material can be compacted by the platen 20.

The knife assembly can be provided by, for example, a first cutting surface 28 on the platen 20 and a second cutting surface 30 on the frame 12. When the first cutting surface 28 engages the second cutting surface 30, the material between them is severed. The first cutting surface 28 can be provided by a hardened bar or other structure that extends across a front wall upper portion of the platen 20. And the second cutting surface 30 can be provided by a hardened bar or other structure that extends across an opposite wall upper portion of the charging chamber 14.

The first cutting surface 28 can be oriented downward and the second cutting surface 30 can be oriented upward so that they engage each other to cut the material. In this configuration, when the cutting surfaces 28 and 30 engage each other they generate downward forces on the platen 20. Alternatively, the cutting surfaces can be arranged in other configurations that produce upward, lateral, a combination of these, and/or other forces on the platen. And other knife assemblies can be suitably employed depending on the application.

Figure 4:
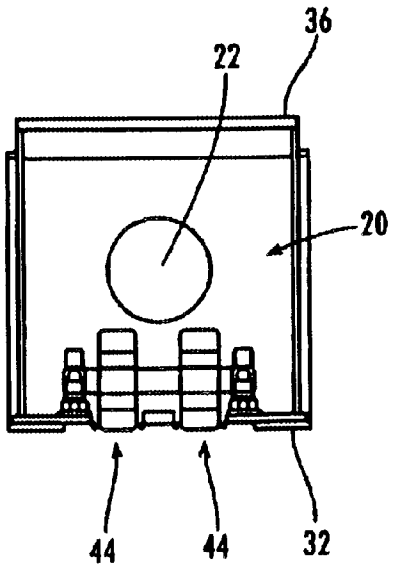
FIG. 4 is a front elevation view of the wheeled platen of FIG. 3.
Figure 3:
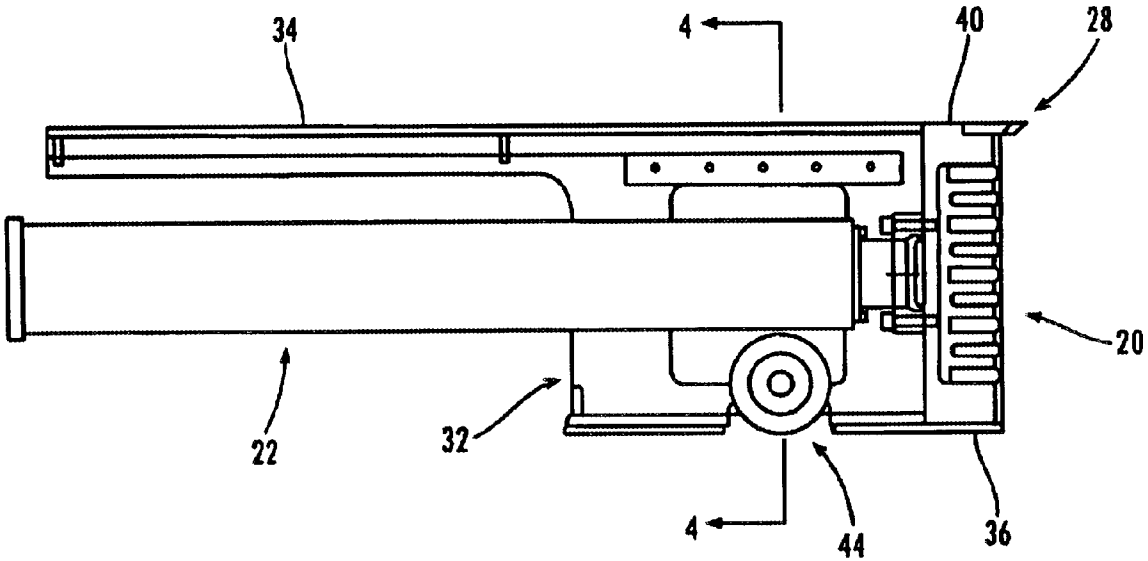
FIG. 3 is a side elevation view of a wheeled platen of the compacting machine of FIG. 1.

Referring additionally to FIGS. 3 and 4, in order to compact the material in the charging chamber 14, the platen 20 moves through the charging chamber and compresses the material against the walls of the charging chamber and/or the walls of the compression chamber 16. To accomplish this compacting, the platen 20 may have a shape that generally conforms to the cross-sectional shape of the charging chamber 14 and/or the compression chamber 16. For example, the platen may be provided by a slab, sheet, block, or other member for compacting having a generally rectangular shape or another regular or irregular shape. It will be understood, then, that the platen can be provided by any type of structure for compacting the material in the charging chamber, not just conventional platens.

Also, the platen 20 has a support 32 with an elongated upper portion 34 that blocks additional material from entering the charging chamber 14 from the hopper 18 as the platen moves through the charging chamber. Therefore, the length of the elongated portion 34 is selected to be at least as much as the length of the hopper 18.

To help support the platen 20 as it moves through the charging chamber 14, the platen 20 has a sliding surface 36 and the charging chamber 14 has a bearing surface 38 upon which the platen slides with zero clearance. For example, when the machine 10 is oriented horizontally the platen sliding surface 36 can be the bottom of the platen 20 and the bearing surface 38 can be the floor of the charging chamber 14. The platen sliding surface 36 contacts the bearing surface 38 and at least partially supports the platen on it. Details of the amount of the platen's weight that is supported by the bearing surface 38 are provided below.

Additionally, the platen 20 has a guide surface 40 and the charging chamber 14 has one or more guide members 42. For example, the platen guide surface 40 can be the top of the platen 20 and the charging chamber guides 42 can be positioned at the top of the charging chamber 14 when the machine 10 is oriented horizontally. In this configuration, the guides 42 slidably engage and constrain the platen guide surface 40 so that the platen 20 cannot move upward. In this way, the platen bottom 36 cannot be elevated from the floor 38 of the charging chamber 14 to allow material under the platen.

Accordingly, the platen sliding surface 36 cooperates with the charging chamber bearing surface 38, and the platen guide surface 40 cooperates with the charging chamber guides 42, to guide the platen 20 through the charging chamber 14 to compact the material load. The close fit between the platen sliding surface 36 and the charging chamber bearing surface 38 and between the platen guide surface 40 and the charging chamber guides 42 hinder material from getting behind the platen and interfering with the operation of the machine 10.

Figure 5:
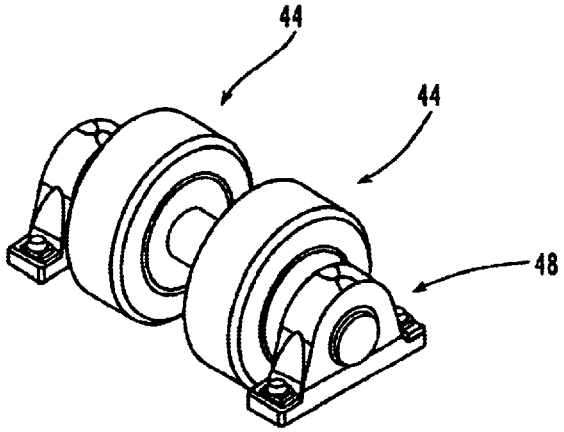
FIG. 5 is a perspective view of the platen wheels of the compacting machine of FIG. 1.
Figure 6:
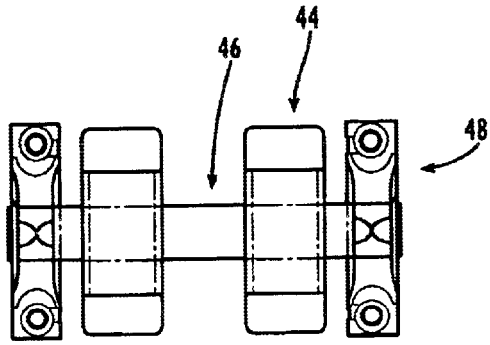
FIG. 6 is a plan view of the platen wheels of FIG. 5.
Figure 7:
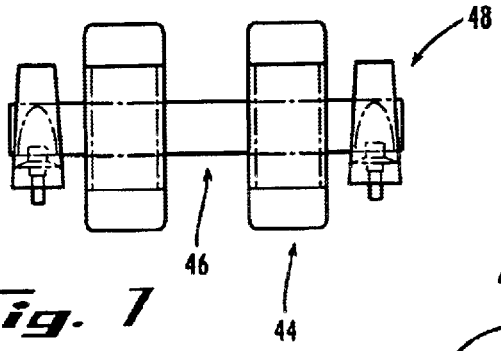
FIG. 7 is a front elevation view of the platen wheels of FIG. 5.

Referring additionally to FIGS. 5–7, the platen 20 has one or more wheels 44 that assist the platen sliding surface 36 in supporting the platen 20 on the bearing surface 38. The wheels 44 are rotatably coupled to the platen, for example, by axles 46 and bearings 48. In a typical commercial embodiment two wheels 44 are provided, though more or less can be suitably employed. Although the wheels 44 are shown in the drawing figures mounted to the support 32 of the platen 20, they can be mounted to another part of the platen.

The wheels 44 are made of a resilient material selected so that they deform somewhat under the weight of the platen 20. For example, the wheels can be made of hard plastic or another elastomer with a modulus of elasticity that is substantially less than that of steel. Also, the wheels can be provided by conventional tires on rims, or by rollers, sprockets and belts, or other structures.

The cooperation between the wheels 44 and the platen sliding surface 36 will now be described. The wheels 44 are configured to support a substantial portion of the weight of the platen 20 to mitigate sliding friction between the platen sliding surface 36 and the charging chamber bearing surface 38. But the platen sliding surface 36 supports enough of the weight of the platen 20 that none or little of the material can pass under it. For example, the machine 10 can be configured with the wheels 44 supporting a majority of the weight of the platen 20 and the platen sliding surface 36 supporting a minority fraction of the weight of the platen. In a typical commercial embodiment, the platen wheels 44 support about 80–90 percent of the platen weight and the platen sliding surface 36 supports the rest of the platen weight. Of course, the wheels 44 can be configured to support more or less of the platen weight than that just mentioned.

Accordingly, the wheels 44 have a size and resiliency selected so that they will deform under the weight of the platen 20 but, before they deform to support all of the platen weight, the platen contacts the charging chamber bearing surface 36, which then assists in supporting the platen. Because the bulk of the platen weight is supported by the wheels 44, the frictional forces between the platen sliding surface 36 and the charging chamber bearing surface 38 are minimized. This results in superior performance of the compacting machine 10. And because some of the platen weight is supported by the platen sliding surface 36, a close fit is maintained between it and the bearing surface 38. In this way, little or none of the material can get under the platen 20. And because the wheels 44 are resilient, the downward forces on the platen 20 from the shearing by the knife assembly are borne on the chamber bearing surface 38 by the platen sliding surface 36.

Thus, the resilient wheels 44 are deformable from an unloaded state (when not supporting any of the platen weight) to a loaded state (supporting some of the platen weight). And if some of the material does get under the platen 20, the wheels 44 can further deform as they roll over the material so that the platen top 40 does not jam upward into the guides 42 and stop or hinder the platen motion.

Figure 8:
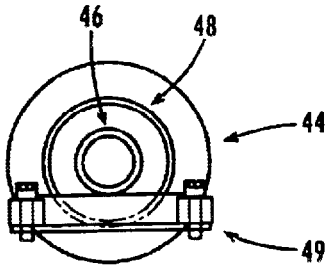
FIG. 8 is a side elevation view of the platen wheels of FIG. 5.

Over the course of time, the platen bottom 36 wears away due to frictional forces. To maintain the desired sliding contact between the platen bottom 36 and the sliding surface 36, a shim 49 can be installed on the platen 20 under the wheel bearings 48 (see FIG. 8).

Figure 9:
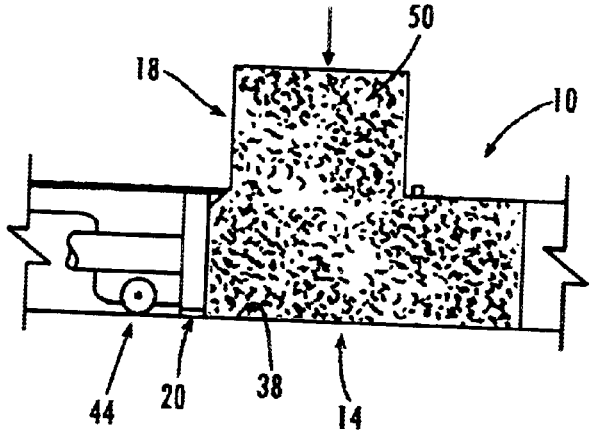
FIG. 9 is a schematic diagram of the compacting machine of FIG. 1, showing material being loaded from the hopper into the charging chamber of the machine.
Figure 10:
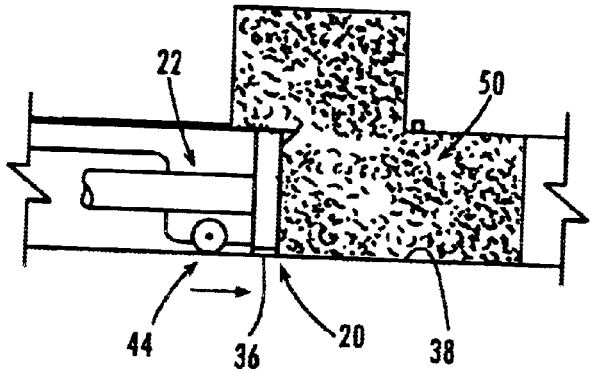
FIG. 10 is a schematic diagram of the compacting machine of FIG. 1, showing the platen advancing into the charging chamber to compact the material.
Figure 11:
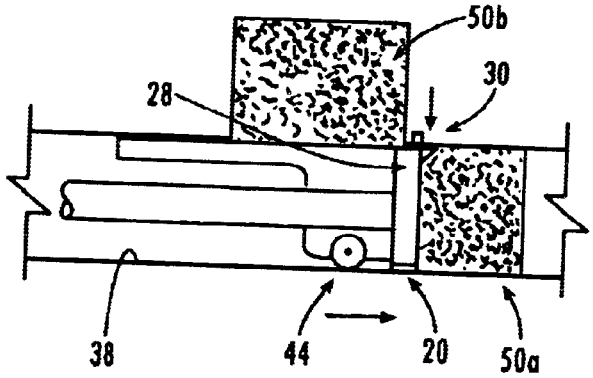
FIG. 11 is a schematic diagram of the compacting machine of FIG. 1, showing the machine knife assembly shearing off the load of material in the charging chamber from the remainder of the material still in the hopper.

Referring now to FIGS. 9–11, the operation of the compacting machine 10 will be described. In FIG. 9, the material 50 is loaded (as shown by the large arrow) through the hopper 18 into the charging chamber 14. In this position, a substantial portion of the weight of the platen 20 is supported by the resilient wheels 44, which are deformed somewhat under the weight of the platen, and the rest of the platen weight is supported by the platen sliding surface 38.

In FIG. 10, the platen 20 is moved forward (as shown by the large arrow) by the actuator 22 to begin compacting the material 50 in the charging chamber 14. Because most of the weight of the platen 20 is supported by the somewhat deformed wheels 44, the frictional forces on the bearing surface 38 are mitigated. But because the rest of the weight of the platen 20 is supported by the platen sliding surface 36, the material 50 has a hard time getting under the platen. And if some of the material does get under the platen 20, the resilient wheels 44 further deform as they roll over the material so that the platen top 40 does not jam into the guides 42 and stop or hinder the platen motion.

In FIG. 11, the platen 20 has moved forward (as shown by the large horizontal arrow) through the charging chamber 14 enough for the knife assembly 28 and 30 to shear off the load 50*a* of material to be compacted from the rest of the material 50*b*. Because the platen 20 contacts, but slides across, the bearing surface 38, any additional downward forces are borne by the platen sliding surface 36. Thus, the downward shearing forces (as shown by the large vertical arrow) generated by the knife assembly are carried by the platen sliding surface 36.

Figure 12:
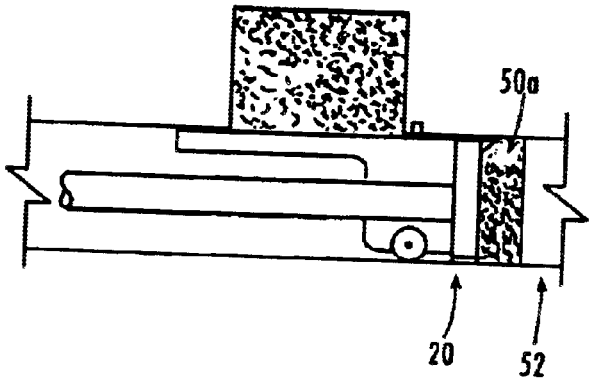
FIG. 12 is a schematic diagram of the compacting machine of FIG. 1, showing the sheared off material load compacted into a dense block.

In FIG. 12, the platen 20 has moved past the knife assembly and the material load 50*a* has been compacted into a dense bundle. At this point, the bundle can be baled by the baling section 52, if so desired. Then the platen 20 can be retracted and the process repeated.

Accordingly, the unique design of the compacting machine permits the platen to compact paper and/or other waste material in a highly efficient manner without periodically seizing up. In particular, the platen compacts the waste material by a low-friction platen motion that does not permit material debris under the platen. Because of this, the machine uses more of the available power in the compacting process, with less power wasted from friction.

While the invention has been shown and described in preferred forms, it will be apparent to those skilled in the art that many modifications, additions, and deletions can be made therein without departing from the spirit and scope of the invention as set forth in the following claims.

What is claimed is:

1. A machine for compacting material, comprising:

a frame with a charging chamber defined therein for receiving a load of the material, the charging chamber having a bearing surface;

a platen movable within the charging chamber to compact the material load, the platen having a sliding surface that slidably contacts the bearing surface and at least partially supports the platen on the bearing surface; and one or more wheels rotatably coupled to the platen, the wheels contacting the bearing surface and at least partially supporting the platen on the bearing surface, wherein the wheels are made of a resilient material selected so that the wheels deform from an unloaded state to a loaded state when at least partially supporting the platen weight.

2. The machine of claim 1, wherein the wheels are made of an elastomeric material.

3. The machine of claim 1, wherein the bearing surface is defined by a floor of the charging chamber and the sliding surface is defined by a bottom of the platen.

4. The machine of claim 3, wherein the platen has a guide surface and the charging chamber has one or more guides that slidably engage and constrain the platen guide surface so that the platen bottom can not be elevated from the charging chamber floor.

5. The machine of claim 1, further comprising a knife assembly coupled to the machine and adapted to shear off the load of material in the charging chamber as the platen is moved in the charging chamber, wherein the shearing generates downward forces on the platen and the downward forces are borne on the chamber bearing surface by the platen sliding surface.

6. The machine of claim 1, further comprising an actuator operably coupled to the platen and configured to move the platen in the charging chamber.

7. A machine for compacting material, comprising:

a frame with a charging chamber defined therein for receiving a load of the material, the charging chamber having a bearing surface;

a platen movable within the charging chamber to compact the material load, the platen having a sliding surface that slidably contacts the bearing surface and at least partially supports the platen on the bearing surface; and one or more wheels rotatably coupled to the platen, the wheels contacting the bearing surface and at least partially supporting the platen on the bearing surface, wherein the wheels support a majority fraction of the weight of the platen to mitigate sliding friction and the sliding surface contacts and supports a minority fraction of the weight of the platen so that none or little of the material can pass under the platen, and wherein the wheels deform from an unloaded state to a loaded state when supporting the majority fraction of the platen weight.

8. A machine for compacting material, comprising:

a frame with a charging chamber defined therein for receiving a load of the material, the charging chamber having a floor;

a platen movable within the charging chamber to compact the material load, the platen having a bottom that slidably contacts the floor and that supports enough of the weight of the platen on the floor that none or little of the material can pass under the platen;

one or more wheels rotatably coupled to the platen, the wheels contacting the floor and supporting a substantial portion of the weight of the platen on the floor to mitigate sliding friction, wherein the wheels are made of a resilient material and deform from an unloaded state to a loaded state when supporting the substantial portion of the platen weight;

a knife assembly with at least one cutting surface on the platen, the knife assembly adapted to shear off the load of material in the charging chambers the platen is moved in the charging chamber, wherein the shearing generates downward forces on the platen and the downward forces are borne on the chamber floor by the platen bottom; and an actuator operably coupled to the platen and configured to move the platen in the charging chamber.

9. The machine of claim 8, wherein the wheels support a majority fraction of the weight of the platen and the sliding surface supports a minority fraction of the weight of the platen.

10. The machine of claim 8, wherein the platen has a guide surface and the charging chamber has one or more guides that slidably engage and constrain the platen guide surface so that the platen bottom can not be elevated from the charging chamber floor.

11. The machine of claim 10, wherein the wheels are further deformable from the loaded state so that if some of the material passes under the platen the wheels can further deform as they roll over the material so that the platen top does not jam into the guides and stop the platen motion.

12. The machine of claim 8, wherein the platen includes a shim supporting the wheel-to-platen coupling.

13. The machine of claim 8, wherein the knife assembly comprises a first cutting surface formed on or coupled to the platen and a second cutting surface formed on or coupled to the frame.

14. The machine of claim 13, wherein the first cutting surface comprises a bar extending across and forward from a front wall upper portion of the platen and the second cutting surface extends across a distal wall upper portion of the charging chamber.

15. The machine of claim 8, wherein the actuator comprises a hydraulic ram.

16. The machine of claim 8, further comprising a compression chamber defined in the frame and in communication with the charging chamber.

17. The machine of claim 8, further comprising a hopper in communication with the charging chamber.

* * * * *